United States Patent [19]

Anderie

[11] 4,281,467

[45] Aug. 4, 1981

[54] SPORTS SHOES

[75] Inventor: Wolf Anderie, Strasbourg, France

[73] Assignee: Adidas Fabrique de Chaussures de Sport, Landersheim, France

[21] Appl. No.: 71,383

[22] Filed: Aug. 30, 1979

[30] Foreign Application Priority Data

Sep. 4, 1978 [FR] France ..... 78 25409

[51] Int. Cl.[3] ..... A43B 13/04; A43B 13/26; A43C 15/00

[52] U.S. Cl. ..... 36/32 R; 36/59C; D2/320

[58] Field of Search ..... 36/32 R, 59 R, 59 C, 36/43, 30 R; D2/319-321

[56] References Cited

U.S. PATENT DOCUMENTS

| | | | |
|---|---|---|---|
| D. 186,154 | 9/1959 | Zerkowitz | D2/320 X |
| D. 201,864 | 8/1965 | Smith | D2/320 |
| 1,289,106 | 12/1918 | Bullock | 36/32 R |
| 4,075,772 | 2/1978 | Sicurella | 36/43 |
| 4,130,947 | 12/1978 | Denu | 36/32 R |

FOREIGN PATENT DOCUMENTS

| | | | |
|---|---|---|---|
| 1114407 | 9/1961 | Fed. Rep. of Germany | 36/43 |
| 2404803 | 8/1975 | Fed. Rep. of Germany | 36/32 R |

*Primary Examiner*—James Kee Chi
*Attorney, Agent, or Firm*—Brisebois & Kruger

[57] ABSTRACT

An elastic sport shoe sole having a plurality of parallel ribs, and each rib is provided on its length alternate zones of different types, one type is a downwardly rounded section of which the width is substantially each to the height and the other type is a narrow section in the form of a lamellar of which the width is small with respect to the height.

4 Claims, 4 Drawing Figures

SPORTS SHOES

FIELD OF INVENTION

The present invention relates to a new sole for shoes intended for use in indoor sports.

It is known that the majority of floor coverings of indoor sports areas, whether they are of parquet or synthetic materials, have the characteristic of being relatively slippery.

OBJECTS OF INVENTION

An object of the present invention is to provide a sole for shoes which has the characteristic of limiting sliding of the shoes to an extent compatible with the normal practice of indoor sports such as table tennis, volley ball, hand ball, badminton, etc.

The soles according to the invention have the advantage of controlling the degree of slide between the shoe and the ground: a complete absence of slide would have disadvantages and even risk of accident for sportsmen wearing the shoe.

Further, the structure of the sole according to the invention is such that it ensures a certain flexibility of contact between the foot and the ground which is especially advantageous in the case where the ground itself only has a very low elasticity.

SUMMARY OF INVENTION

The present invention has as its object a new industrial product comprising a sole for shoes intended for use in indoor sports characterised in that it comprises on at least a major part of its surface, ribs which are parallel to each other having zones of downwardly rounded section and of which the width is substantially equal to the height and zones having a narrow section of lamellar shape of which the width is small with respect to the height, the heights of the different sections being the same.

The sole is advantageously made of an elastomer of which the Shore hardness is from 50 to 65 and preferably between 55 and 60.

According to a preferred embodiment of the invention each rib has in the direction of its length zones having alternately the two types of section mentioned above, one zone which has a section of one type being surrounded laterally by two zones having a section of the other type.

The ribs are advantageously arranged transverse with respect to the sole.

In one variant, the ribs may be arranged as arcs of concentric circles while remaining parallel to each other.

The sole according to the invention may comprise two types of rib. In particular it is possible to arrange the circular ribs in the forward end of the sole, centering these ribs on the internal and external edges of the shoe, whereas the rest of the sole comprises transverse parallel ribs.

DESCRIPTION OF SPECIFIC EMBODIMENTS

In order to facilitate comprehension of the invention there will now be described by way of illustration and not limitation embodiments shown in the accompanying drawing.

Figure 1:
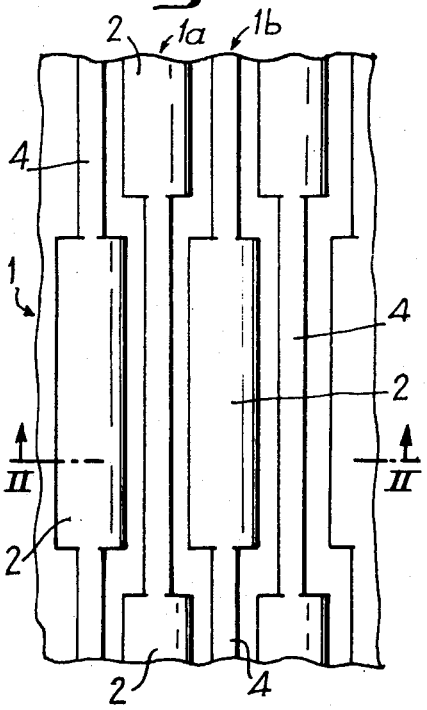
FIG. 1 shows a view in plan on a large scale of a sole of a shoe comprising ribs according to the invention.
Figure 2:
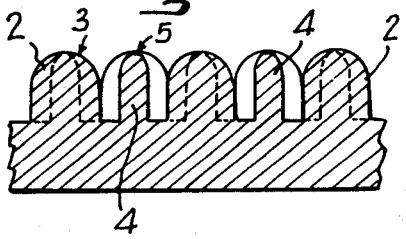
FIG. 2 is a view in section along II-II of FIG. 1.

It is seen in FIGS. 1 and 2 how the same rib 1 has zones 2 of rounded section 3 directed downwardly from the sole and of which the height is substantially equal to the width, whereas the zones 4 have a section of the same height as the section of the zones 2 but a width which is small with respect to the height.

The end 5 of the section of zones 4 is also rounded.

It is seen clearly in FIG. 1 how the zones 2 and 4 of the different parallel ribs 1, 1*a* and 1*b* are imbricated one in the others.

This arrangement has the advantage of limiting to a certain extent sliding of the sole in the direction parallel to the general direction of the ribs.

In the embodiment shown in FIGS. 1 and 2 the ribs have in the zones 3 a width of 3 mm and a height of 2.5 mm: these dimensions are substantially equal. On the other hand, in the zones 4 they have a same height of 2.5 mm and a width of 1 mm.

The zones 2 and 4 alternate every 13 mm approximately.

Figure 3:
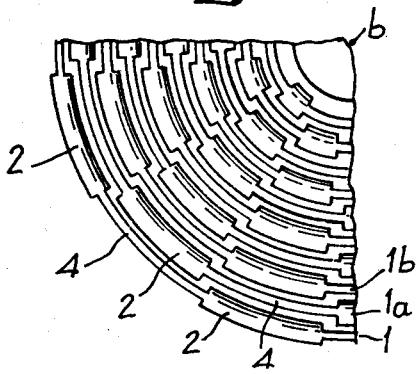
FIG. 3 is a view in plan of part of a sole showing how it is possible to make concentric ribs in a sole according to the invention.

There is shown in FIG. 3 how the ribs according to the invention may be arranged as arcs of concentric circles. There are shown in FIG. 3 zones 2 and 4 of the different ribs 1, 1*a*, 1*b*, etc.

It will be seen that the ribs thus arranged allow a certain sliding in the direction of rotation about the centre 6 of the different ribs while opposing much more strongly sliding in a radial direction.

Figure 4:
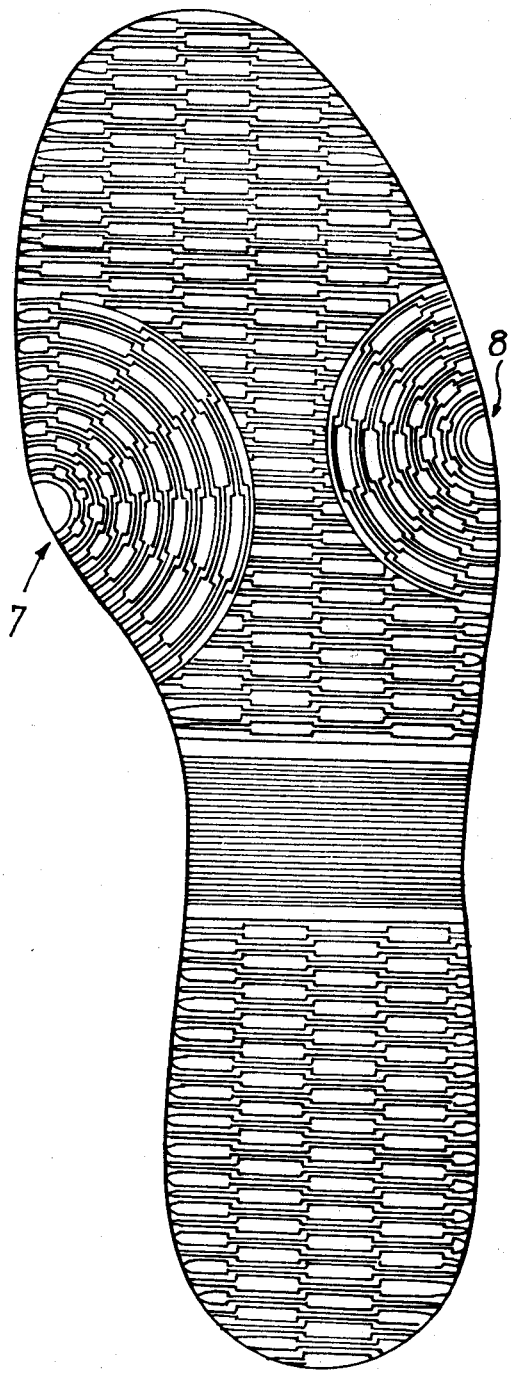
FIG. 4 is a schematic view in plan of a sole according to the invention having transverse ribs and concentric ribs.

There is shown schematically in FIG. 4 a sole of a shoe which comprises two zones 7 and 8 having ribs arranged on concentric circles such as those shown in FIG. 3, whereas the rest of the shoe comprises ribs arranged transversely on the sole.

In the embodiment of FIG. 4 there is obtained a good resistance to sliding in all directions when the sole is placed flat on the ground, whereas when the person wearing the shoe provided with the sole according to the invention is in contact with the ground on the forward part of the shoe towards the interior or towards the exterior, there is a certain possibility of pivoting about the centres of the concentric ribs 7 or 8.

These zones 7 and 8 also resist lateral sliding of the forward part of the sole when the latter rests flat on the ground.

It will be understood that the embodiment which has been described above does not have any limiting character and it may receive any desirable modifications without leaving the scope of the invention.

I claim:

1. A sole for shoes intended for indoor sports comprising on at least a major part of its floor engageable surface, ribs which are parallel to each other and extend generally transversely with respect to the length of the sole, each rib having in the direction of its length alternate zones of different types, one type having a downwardly rounded section and of which the width is substantially equal to the height and the other type having a narrow section in the form of lamellar of which the width is small with respect to the height, the heights of the ribs in the different zones being the same, each zone of each rib of each type being bounded laterally respectively, by two zones of adjacent ribs of the other type.

2. A sole according to claim 1, further comprising arcuate ribs in a concentric pattern, centered on at least one point generally situated adjacent at least one external edge of the forward half of the sole, each arcuate rib having alternate zones of different types, one type having a downwardly rounded section and of which the width is substantially equal to the height and the other type having a narrow section in the form of lamellar of which the width is small with respect to the height, the heights of the ribs in the different zones being the same, each zone of each arcuate rib being bounded laterally respectively by two zones of adjacent ribs of the other type, substantially throughout said pattern.

3. A sole according to claim 1 or 2, characterised in that it is made of an elastomer of which the Shore hardness is from 50 to 65.

4. A sole according to claim 3, characterised in that it is made of an elastomer of which the Shore hardness is from 55 to 60.

* * * * *